US005503395A

United States Patent [19]

Cook

[11] Patent Number: 5,503,395

[45] Date of Patent: Apr. 2, 1996

[54] GOLF PUTTING PRACTICE DEVICE

[76] Inventor: Robert L. Cook, 2333 Garfield Rd., San Diego, Calif. 92110

[21] Appl. No.: 344,857

[22] Filed: Nov. 25, 1994

[51] Int. Cl.[6] ..... A63B 69/36

[52] U.S. Cl. ..... 273/186.1; 273/187.6; 273/192

[58] Field of Search ..... 273/192, 187.6, 273/186.1, 191 A, 191 R, 192

[56] References Cited

U.S. PATENT DOCUMENTS

| | | | |
|---|---|---|---|
| 2,754,125 | 7/1956 | Engler | 273/192 |
| 2,866,645 | 12/1958 | Cayot | 273/183 |
| 2,929,631 | 3/1960 | Gillon | 273/163 |
| 3,656,752 | 4/1972 | Moriarty | 273/192 |
| 3,857,570 | 12/1974 | Gutierrez et al. | 273/191 |
| 3,934,874 | 1/1976 | Henderson | 273/192 X |
| 4,082,287 | 4/1978 | Berkey | 273/192 X |
| 4,437,669 | 3/1984 | Pelz | 273/192 |
| 4,765,624 | 8/1988 | Sprague | 273/192 X |
| 5,007,646 | 4/1991 | Baber et al. | 273/192 X |

*Primary Examiner*—George J. Marlo
*Attorney, Agent, or Firm*—Brown Martin Haller & McClain

[57] ABSTRACT

A putting practice device and putting practice method for a golfer, the method and device being used on a putting surface with a putter and a golf ball. The putting practice device includes a putting tunnel for placing on the putting surface adjacent to the golf ball. The putting tunnel includes a back panel and an opaque top panel, the opaque top panel having a view port for viewing the golf ball. The putting practice device also includes an adjustable sliding sleeve that is slidably attached to the putting tunnel for variably limiting the length of the golfer's backswing with the putter.

12 Claims, 2 Drawing Sheets

GOLF PUTTING PRACTICE DEVICE

BACKGROUND OF THE INVENTION

1. Field of the Invention

The present invention relates to a putting practice device and method for practicing putting for golfers. More particularly, the present invention relates to a putting practice device and practice putting method for preventing head movement and watching the putter during the backstroke, for promoting eye contact with the ball and good ball contact with the putter, and for restricting the backstroke to allow acceleration through the putting area.

2. Description of Related Art

Various golf putting practice devices have been developed. These devices are designed to eliminate various bad habits and promote various good habits in the golfer.

For example, U.S. Pat. No. 2,866,645 shows a device that has two guide rails on which the ball sits and a vertical wall that acts as a guide for the end of the putter blade when striking the ball. The two guide rails, however, are designed such that the ball is prevented from jumping the rails, and thus no matter how the ball is struck, it will roll in a straight line. This device, therefore, guarantees a perfect hit each time the golfer swings, removing the element of negative feedback resulting from missed hits. Moreover, the vertical wall is primarily used to guide the putter in the strike zone and hence is not used to guide the putter throughout the entire stroke.

Another putting practice device is disclosed in U.S. Pat. No. 2,929,631. This device has a lens ("view indicator") located in the putter blade, indicating to the golfer when his eye is in the proper angular position in relation to the golf club head. Conventional putting teaching, however, clearly requires the eyes to be placed over the ball, and not over the putter blade.

Another putting practice device is disclosed in U.S. Pat. No. 3,934,874, the device being a U-shaped angle plate channel. A dimple is formed on the floor of the channel on which the ball is placed to prevent it from rolling around. Placed over the dimple is a rectangular planar reflective member, i.e., a two-way mirror, which reflects the golfer's eyes when they are placed over the channel. Due to the dimple, the feel of the put will not be the same as a ball struck on a grass surface, because the depth of the dimple must be sufficient to hold the ball, causing the ball to jump on contact. Moreover, the two-way mirror provides no distortion effects on the ball for indicating to the golfer when his head has moved, and the two-way reflective effect of the mirror distracts from concentration levels because the golfer will see his face and the ball at the same time.

Another putting practice device is disclosed in U.S. Pat. No. 4,082,287, which shows a cantilever device positioned over the putting line, golf ball, and putter. Because the cantilever is a clear plastic through which the ball and putter blade can be seen throughout the stroke, the eyes of the golfer will follow the putter throughout the stroke, an unfavorable result.

U.S. Pat. No. 5,007,646 discloses a trapezoidal vertical planar putter guide, against which the toe of the putter is placed. The putter guide also has a sight ring of various sizes, lengths, and adjustable positions along the guide. The sight ring is placed at a position that is somehow determined to equal the sweet spot in the putting stroke, which determination can be difficult. Because the eyelet portion of the ring does not contain any lens of any kind, and the eyelid diameter is significantly less than the diameter of the ball, the golfer's head can experience significant movement during the putting stroke without the golfer having noticed such movement.

In light of the foregoing, a need exists for a putting practice device and putting practice method that prevents a golfer from moving his head and/or eyes during the putting stroke, that indicates whether the golfer's eyes are directly over the ball, that prevents the golfer from watching the putter blade during the stroke, that helps the golfer in eliminating "pushed" or "shoved" strokes, that prevents the putter from being lifted on the backstroke and follow-through, and that aids the golfer in determining the proper backstroke for shorter puts.

SUMMARY OF THE INVENTION

Accordingly, the present invention is directed to a putting practice device and method for practicing putting that substantially obviates one or more of the problems due to limitations and disadvantages of the related art.

Additional features and advantages of the invention will be set forth in the description that follows, and in part will be apparent from the description, or may be learned by practice of the invention. The objectives and other advantages of the invention will be realized and attained by the apparatus and method particularly pointed out in the written description and claims of this application, as well as the appended drawings.

To achieve these and other advantages and in accordance with the purpose of the invention as embodied and broadly described herein, the present invention is a putting practice device for a golfer, the device being used on a putting surface with a putter and a golf ball. The putting practice device includes a putting tunnel placed on the putting surface adjacent to the golf ball. The putting tunnel includes a back panel and an opaque top panel, the opaque top panel having a view port for viewing the golf ball, the view port including a lens and a sidewall extending upward from the opaque top panel. The putting practice device also includes a removable and adjustable sliding sleeve that is slidably attached to the putting tunnel for variably limiting the length of a backswing the golfer takes with the putter.

In another aspect, the invention is a method for a golfer to practice a putting stroke on a putting surface with a putter and a golf ball. The method comprises confining a view the golfer has of the golf ball, the view being limited by a view port through an opaque top panel on a putting tunnel, the putting tunnel being adjacent the golf ball on the putting surface. The method further comprises variably limiting a length of a backswing of the golfer with an adjustable sliding sleeve slidably attached to the putting tunnel, and guiding the putter through the putting stroke with a back panel on the putting tunnel.

It is to be understood that both the foregoing general description and the following detailed description are exemplary and explanatory only and are not restrictive of the invention, as claimed.

The accompanying drawings are included to provide a further understanding of the invention and are incorporated in and constitute a part of this specification. The drawings are also included to illustrate the embodiments of the invention and, together with the description, to serve to explain the principles of the invention.

DETAILED DESCRIPTION OF THE INVENTION

Reference will now be made in detail to the present preferred embodiment of the invention, an example of which is illustrated in the accompanying drawings. Wherever possible, the same reference numbers will be used throughout the drawings to refer to the same or like parts.

Figure 1:
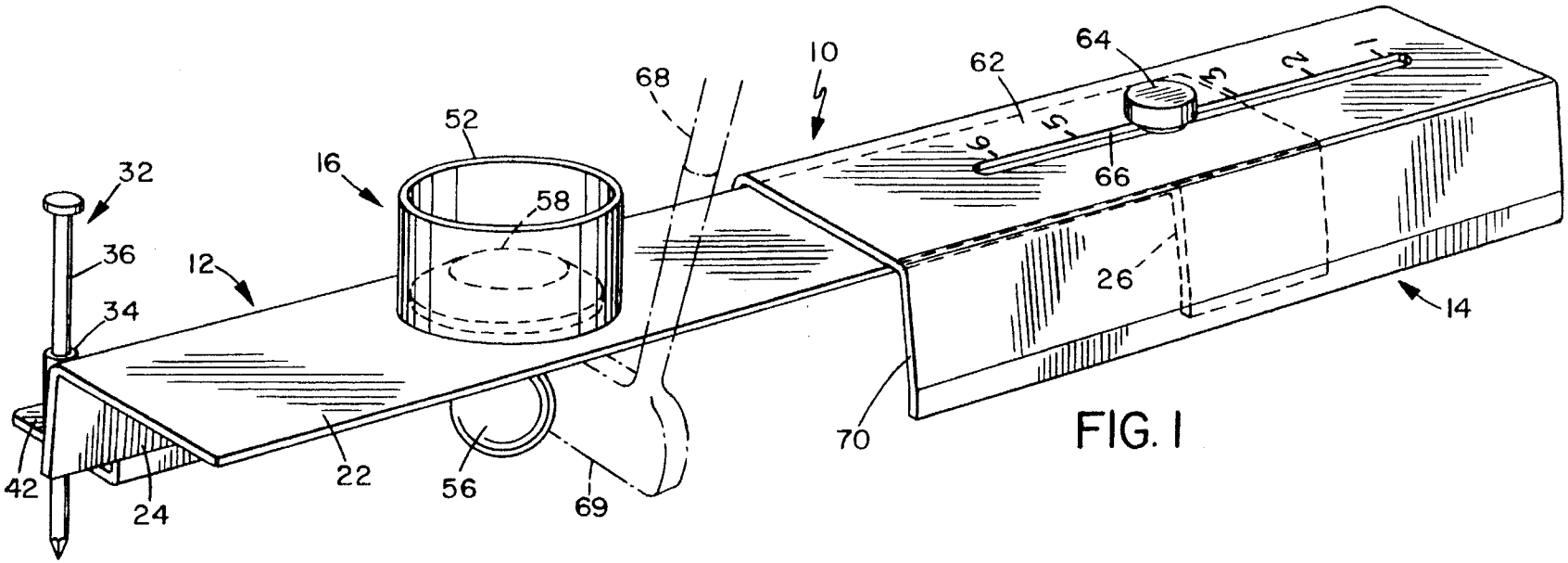
FIG. 1 is a perspective view of the putting practice device.
Figure 2:
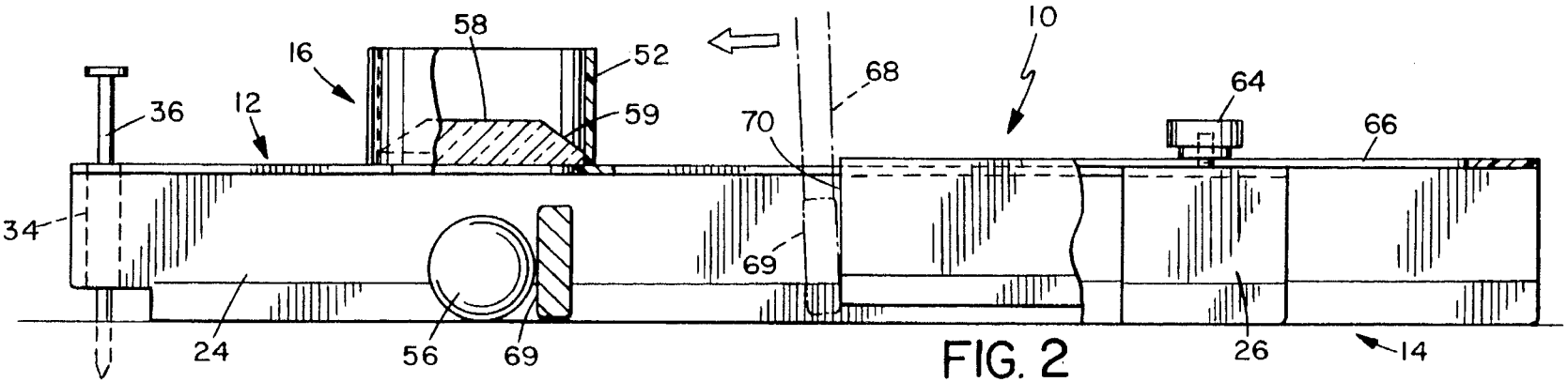
FIG. 2 is a side elevation view of the device showing the ball and putter positions.

Referring to FIG. 1, an exemplary embodiment of the present invention is shown and is designated generally by reference numeral 10. The putting practice device 10 includes a putting tunnel 12, a removable and adjustable sliding sleeve 14, and a view port 16.

The putting tunnel 12 is preferably an inverted L-shaped member having an opaque top panel 22 and a back panel 24. Located at the rear end of the putting tunnel 12 is a stabilizer leg 26, which is substantially parallel to the back panel 24. Accordingly, when viewing the putting tunnel from the rear, i.e., the end having the stabilizer leg 26, the putting tunnel appears as an inverted U-shape. The putting tunnel 12 can be made from a variety of materials, including plastic, metal, wood, or any other material that will provide a structure strong enough to withstand the forces generated by a golfer during a putting stroke.

Preferably, the putting tunnel 12 measures approximately two feet in length; the top panel 22 measures approximately 2¾" in width, with the span of the bottom portion of the tunnel being approximately 3½" in width; and the back panel 24 is approximately 2" in height. Due to the height of the back panel 24, the inside height of the putting tunnel 12 will also be approximately 2". (The standard golf ball has a diameter of 1¾"). The ceiling of the putting tunnel 12 thus keeps the putter blade 69 low to the ground and prevents the blade from being lifted during the putting stroke. The length of the putting tunnel 12 is designed such that the golfer can align his feet with the ends (or sides) of the tunnel, thereby creating a stable and square putting stance. The back panel 24 of the putting tunnel 12 extends the full length of the tunnel, while the front wall is open, vertically, from the putting surface to the top panel 22, except for the portion enclosed by the stabilizer leg 26. The back panel 24 provides a guide that the putter 68 slides along on the backstroke and the throughstroke. This panel prevents the putter blade 69 from moving outside the proper putting line, thereby eliminating "pushed" or "shoved" strokes. The back panel 24 also maintains the putter 68 on a straight line back and through the putting stroke, as many golf teachers support. At the same time, however, if the golfer so chooses, he may bring the putter 68 back on an inside line and finish on an inside line, as other teachers advocate.

The top panel 22 of the putting tunnel 12 is made from an opaque material, such as plastic, wood, or metal. Being opaque, the top panel 22 prevents the golfer from watching the putter blade 69 during the putting stroke. Concentration, therefore, is directed entirely on the golf ball 56, which can be seen by the golfer only through the view port 16.

The putting tunnel 12 may be secured to the ground via an anchoring device 32, which allows the putting tunnel 12 to be anchored to turf when practicing on a putting green surface. The anchoring device 32 includes a hollow sleeve 34 attached to the front end of the putting tunnel 12, i.e., the end corresponding to the putting stroke follow through, not backstroke. A 10 penny sized nail 36 is placed within the hollow sleeve 34 in order to anchor the putting tunnel 12 to the ground, as well as to stabilize it. As will be readily apparent to those skilled in the art, additional anchoring devices can be placed along the length of the putting tunnel 12. Moreover, those skilled in the art will recognize that other types of anchoring devices can be used, such as posts extending directly from the bottom of the back panel 24 and/or stabilizer leg 26.

A base member 42 may be attached to, or be an extension of, the back panel 24 in order to further stabilize the putting tunnel 12 on the putting surface. This base member 42 is designed to engage the putting surface and to substantially parallel the top panel 22.

Figure 4:
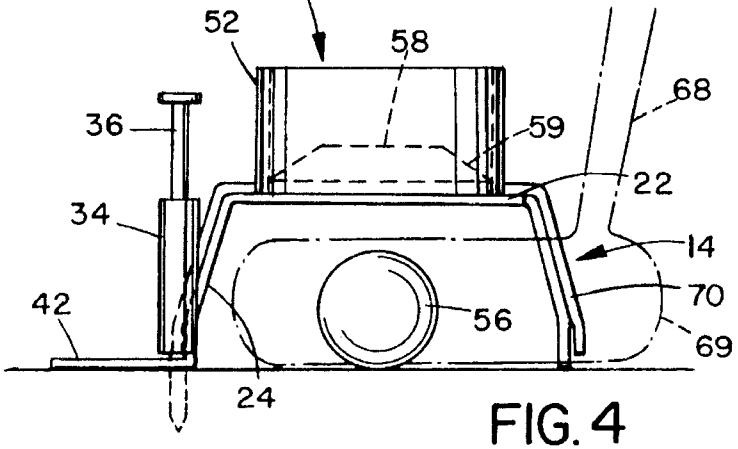
FIG. 4 is a front end view of the device.

Located on top of the putting tunnel 12 is the view port 16. Referring now to FIG. 4, the view port 16 is shown from an end of the putting tunnel 12. The view port 16 may include a sidewall 52 and a lens 54. The sidewall 52 of the view port 16 should be of sufficient height as to require a golfer to place his eyes directly over the ball 56 in order to see it. The purpose and design of the view port 16 is to focus the attention of the golfer on the ball. Preferably, the sidewall 52 is made from 2½" diameter PVC piping secured to the top panel 22 of the putting tunnel 12. It will be appreciated that other materials may be used for the sidewall 52, provided the selected material is opaque.

Figure 5:
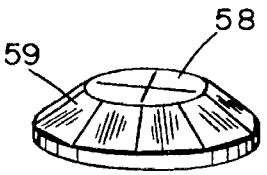
FIG. 5 is a perspective view of the sighting lens.

The lens 54 may be a specially designed optical lens of approximately 2¼" in diameter and approximately 1" in depth at a clear portion 58 located in the center of the lens. As illustrated in FIG. 5, the clear portion 58 may have cross hairs and is approximately 1¾" in diameter.

Concentric to the clear portion 58, and comprising the remainder of the diameter of the lens 54, is a faceted portion 59. Referring again to FIG. 5, the faceted portion 59, as it progresses from the center to the extremity of the lens 54, decreases in depth. As a result, when the golf ball 56 is centered on the cross hairs of the clear portion 58, the ball will appear as a round object, only so long as the golfer's eyes are directly above the ball 56. Should the golfer's eyes move in any direction (i.e., up, down, left, or right) the ball will appear to change shape. Accordingly, the golfer can maintain the ball 56 in a round appearance when peering through the view port 16 only by keeping his head and eyes perfectly over the ball throughout the entire putting stroke. Consequently, any movement of the golfer's head during the putting stroke will cause the ball, as viewed through the lens 54, to change shape and instantly alert the golfer of any head movement, a crucial factor in good putting.

The removable and adjustable sliding sleeve (or backstop tunnel) 14 is secured to the putting tunnel 12 by a set screw 64. The sliding sleeve 14 is an inverted U-shaped member that fits on top of the putting tunnel 12. Alternatively, the sliding sleeve 14 can be made such that it will fit within the confines of the putting tunnel 12.

The sliding sleeve 14 has a scale 62, which is sequentially numbered, each number preferably corresponding to an inch. That is, the sliding sleeve 14 has a slot 66, next to which is a series of numbers (or scale) 62. The numbers count up sequentially from, for example, 1 to 6, with each number being 1" apart.

Figure 3:
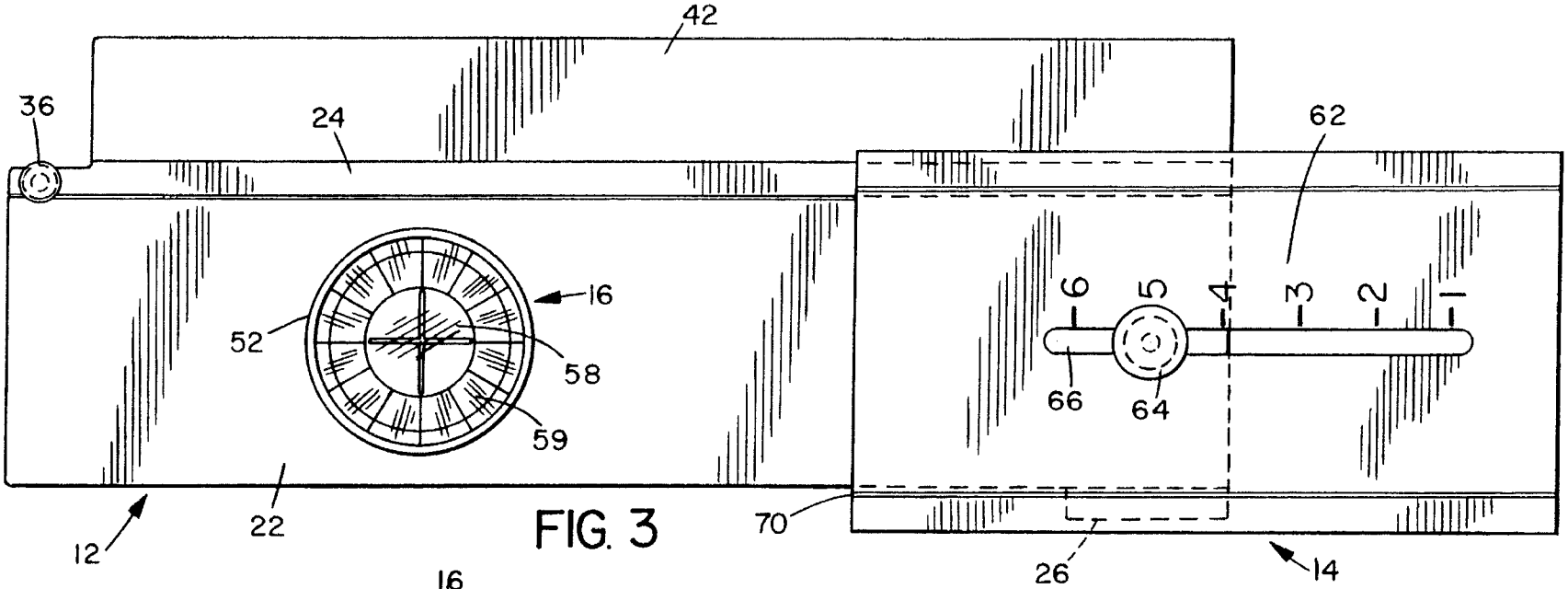
FIG. 3 is a top plan view of the device.

The purpose of the scale 62 is to allow the sliding sleeve 14 to be adjusted such that it will act as a backstop when the putter is taken back in a backswing. When a number on the scale 62 is aligned with the set screw 64, that number indicates the distance, in inches, between the view port 16 and the leading edge 70 of the sliding sleeve 14. For example, as shown in FIG. 3, the set screw 64 is aligned with the number 5. Thus, the putter 68 can be drawn back from the golf ball 56 a maximum of five inches, at which point the blade 69 of the putter 68 will make contact with the leading edge 70 of the sliding sleeve 14, thereby limiting the backstroke to five inches.

The sliding sleeve (or backstop tunnel) 14 is designed to restrict the backstroke of the putter 68. The purpose of the numbered scale 62 is to ascertain the length of the backswing, because it has been determined that a 1" backstroke is proper for a put of 1' in length, a 3" backstroke is proper for a 3' put, a 6" backstroke is proper for a 6' put, and so on. For practicing puts of over 6' in length, the golfer can remove the sliding sleeve 14. The scale 62 need extend no more than 6", because for puts outside 6', distance is controlled more by feel than by mechanics. The sliding sleeve 14 can be made from the same material as the putting tunnel 12 and can be opaque.

It will be apparent to those skilled in the art that various modifications and variations can be made in the present invention without departing from the spirit or scope of the invention. Thus, it is intended that the present invention cover the modifications and variations of this invention, provided they come within the scope of the appended claims and their equivalents.

What is claimed is:

1. A putting practice device for a golfer, said putting practice device being used on a putting surface with a putter and a golf ball, comprising:

a putting tunnel for placing on said putting surface adjacent to said golf ball, said putting tunnel including a back panel and an opaque top panel, said opaque top panel having a view port for viewing said golf ball; and an adjustable sliding sleeve slidably attached to said putting tunnel for variably limiting the length of a backswing of said golfer with said putter.

2. The putting practice device recited in claim 1 wherein the putting tunnel has an inverted L-shape, the top panel forming the horizontal top-portion of said inverted L-shape and the back panel forming the vertical sideportion of said inverted L-shape.

3. The putting practice device recited in claim 2 wherein the putting tunnel has a front end and a rear end and the top panel has a golfer side and a back side; and wherein the putting tunnel includes a stabilizer leg extending from said golfer side of the top panel to the putting surface, said stabilizer leg being located at said rear end of the putting tunnel, whereby the putting tunnel has an inverted U-shape at said rear end.

4. The putting practice device recited in claim 1 wherein the sliding sleeve includes a scale for indicating the maximum distance of the backswing.

5. The putting practice device recited in claim 4 wherein the scale has a plurality of sequentially numbered indicators, said plurality of indicators being one inch apart.

6. The putting practice device recited in claim 5, further comprising a mechanism for securing the sliding sleeve at each of the plurality of sequentially numbered indicators.

7. The putting practice device recited in claim 1 wherein the view port includes a lens and a sidewall extending upward from the opaque top panel and surrounding said lens.

8. The putting practice device recited in claim 7 wherein the lens has a clear portion and a faceted portion, said clear portion being substantially the same diameter as the golf ball, whereby when the golfer looks through the lens the golf ball will appear round only when the eyes of the golfer are directly above the golf ball.

9. The putting practice device recited in claim 8 wherein the sidewall extends at least two inches above the top panel.

10. The putting practice device recited in claim 1, further comprising a mechanism for securing the putting tunnel to the putting surface.

11. The putting practice device recited in claim 1, further comprising a base member attached to the back panel and substantially parallel to the top panel for stabilizing the putting tunnel on the putting surface.

12. The putting practice device recited in claim 1 wherein the putting tunnel has a length of at least 18 inches.

* * * * *